US006729613B2

(12) United States Patent
Marra, III et al.

(10) Patent No.: US 6,729,613 B2
(45) Date of Patent: May 4, 2004

(54) METHOD FOR OPERATING SHEET PICK AND FEED SYSTEMS FOR PRINTING

(75) Inventors: Michael Anthony Marra, III, Lexington, KY (US); Randall David Mayo, Georgetown, KY (US); Barry Baxter Stout, Lexington, KY (US); Jay William Vessels, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 248 days.

(21) Appl. No.: 09/974,738

(22) Filed: Oct. 10, 2001

(65) Prior Publication Data

US 2003/0067108 A1 Apr. 10, 2003

(51) Int. Cl.[7] ..... B65H 7/20; B65H 9/14

(52) U.S. Cl. ..... 271/10.02; 271/10.03; 271/4.02; 271/4.03

(58) Field of Search ..... 271/3.15, 3.17, 271/10.02, 10.03, 4.02, 4.03, 4.04, 3.16

(56) References Cited

U.S. PATENT DOCUMENTS

| | | | | |
|---|---|---|---|---|
| 4,524,691 A | | 6/1985 | Miller | |
| 4,729,683 A | | 3/1988 | Staniszewski | |
| 4,926,339 A | | 5/1990 | Naso et al. | |
| 5,415,387 A | * | 5/1995 | Suzuki | 271/10.02 |
| 5,433,427 A | | 7/1995 | Ishikawa et al. | |
| 5,466,079 A | | 11/1995 | Quintana | |
| 5,619,240 A | | 4/1997 | Pong et al. | |
| 5,634,635 A | * | 6/1997 | Kobayashi et al. | 271/3.16 |
| 5,676,363 A | * | 10/1997 | Kishida et al. | 271/10.01 |
| 5,692,741 A | * | 12/1997 | Nakamura et al. | 271/10.03 |
| 5,720,477 A | | 2/1998 | Morita et al. | |
| 5,782,468 A | | 7/1998 | Wu et al. | |
| 5,931,090 A | * | 8/1999 | Ohkawa | 101/118 |
| 5,967,506 A | * | 10/1999 | Miki et al. | 271/10.13 |
| 5,980,141 A | | 11/1999 | Donnis | |
| 6,135,439 A | * | 10/2000 | Ikeda | 271/10.03 |
| 6,167,231 A | | 12/2000 | Blackman et al. | |
| 6,206,359 B1 | * | 3/2001 | Hirota et al. | 271/3.15 |
| 6,234,470 B1 | * | 5/2001 | Okitsu et al. | 271/114 |
| 6,298,778 B1 | * | 10/2001 | Onodera et al. | 101/232 |
| 6,533,263 B2 | * | 3/2003 | Tamura | 271/10.01 |
| 6,572,103 B1 | * | 6/2003 | Tranquilla | 271/265.02 |

FOREIGN PATENT DOCUMENTS

JP 5169741 7/1993

* cited by examiner

*Primary Examiner*—Donald P. Walsh
*Assistant Examiner*—Daniel K Schlak
(74) *Attorney, Agent, or Firm*—Thompson Hine LLP

(57) ABSTRACT

One method operates a pick motor and a separate feed motor to pick and feed a sheet for printing. Desired pick and feed motor velocities are obtained from respective first and second functions of sheet position. Sheet position for obtaining both desired motor velocities is determined by the pick system until a predetermined event. The feed-system sheet position is synchronized to the pick-system sheet position upon the happening of the event. Sheet position for obtaining both desired motor velocities is determined by the feed system after the event. Another method operates a printer pick motor and includes starting picking by driving the pick motor in a first direction, to move a sheet forward, with an input sufficient to prevent any teetering transitions between peaks and valleys of an encoder sensor output which would be falsely counted as forward motion by a single-channel encoder. A further method operates a printer DC pick motor and includes driving the pick motor with a PWM signal which does not change polarity during picking of a sheet.

19 Claims, 5 Drawing Sheets

METHOD FOR OPERATING SHEET PICK AND FEED SYSTEMS FOR PRINTING

TECHNICAL FIELD

The present invention relates generally to printers, and more particularly to a method for operating a pick motor of a pick system and a separate feed motor of a feed system to pick and feed a sheet of print media for printing and to a method for operating a pick system to pick a sheet of print media for printing.

BACKGROUND OF THE INVENTION

Printers include inkjet printers having a tray containing paper sheets and having a mechanism for picking the top or bottom sheet from the tray and feeding that sheet into the printing region of the printer. Some conventional inkjet printers have a pick system and a separate feed system and include a pick roller and a separate feed roller as well as a paper-sensing "lever" flag and a nip roller. The pick roller picks the top paper sheet from the paper tray and moves it forward along a paper path toward the feed roller. The paper sheet moves the flag just prior to entering, or as it enters, between the feed roller and the nip roller. Thereafter, the feed roller moves the top edge of the paper sheet backward along the paper path out of the grasp of the nip roller and the feed roller (while the pick roller maintains the trailing edge of the paper sheet in a fixed position) which buckles the paper sheet and aligns the top edge squarely to correct for skew. Then, the feed roller rotates forward drawing the leading edge in square, and the pick roller releases pressure on the paper sheet. Other conventional inkjet printers omit the deskew operation. What is needed is an improved method for coordinating the operation of the pick and feed systems.

Higher-cost dual channel encoders are known in printer pick and feed systems and are used to determine sheet position along both forward and reverse directions of the paper path. Lower cost single channel encoders are known in non-printing applications which can only be used to determine position only along one direction corresponding to rotation of the encoder wheel in a single direction. The encoder wheel has a circular array of transparent portions spaced apart by intervening opaque portions. The encoder has an optical sensor which changes signal level when the edges of the opaque portions rotate past the sensor. Position only along the one direction is determined by counting the number of changes in signal level. However, teetering rotational motion of the encoder wheel causes teetering changes in the signal level when an edge is being sensed by the sensor causing these signal changes to be falsely counted as motion along the forward direction leading to an erroneous determination of position. Likewise, any non-teetering rotational motion of the encoder wheel in a direction opposite to the single direction will be falsely counted as motion along the forward direction leading to an erroneous determination of position. What is needed is a method for using a printer pick system having a single channel encoder which more accurately determines position.

SUMMARY OF THE INVENTION

A first method of the invention is for operating a pick motor of a pick system and a separate feed motor of a feed system to pick and feed a sheet of print media for printing, wherein the pick and feed systems each determine sheet position, and includes steps a) through e). Step a) includes obtaining a desired pick motor velocity for the pick motor from a first function of sheet position. Step b) includes obtaining a desired feed motor velocity for the feed motor from a second function of sheet position. Step c) includes using the sheet position determined by the pick system for both steps a) and b) until the happening of a predetermined event. Step d) includes synchronizing the determined sheet position of the feed system to the determined sheet position of the pick system upon the happening of the predetermined event. Step e) includes using the sheet position determined by the feed system for both steps a) and b) after the happening of the predetermined event.

A second method of the invention is identical to the previously-described first method but also requires the pick system to be in contact with the sheet when the sheet position determined by the pick system is used for both steps a) and b) and further requires the feed system to be in contact with the sheet when the sheet position determined by the feed system is used for both steps a) and b).

A third method of the invention is identical to the previously-described first method but also includes steps f) and g). Step f) includes controlling the pick motor by comparing an actual pick motor velocity determined by the pick system with the desired pick motor velocity. Step g) includes controlling the feed motor by comparing an actual feed motor velocity determined by the feed system with the desired feed motor velocity.

A fourth method of the invention is identical to the previously-described third method but also requires the pick system to be in contact with the sheet when the sheet position determined by the pick system is used for both steps a) and b) and further requires the feed system to be in contact with the sheet when the sheet position determined by the feed system is used for both steps a) and b).

A fifth method of the invention is for operating a pick motor of a pick system to pick a sheet of print media for printing, wherein the pick system has a single-channel pick encoder including an encoder wheel and a sensor. The sensor outputs an oscillating signal having peaks and valleys when the encoder wheel is rotating. The pick system counts the number of transitions between the peaks and valleys to determine sheet position only along a forward direction of the sheet path. The fifth method includes steps a) and b). Step a) includes starting a pick operation of picking a sheet by driving the pick motor in a first direction, to move a sheet along the forward direction of the sheet path, with an input sufficient to prevent any teetering transitions which would be falsely counted as motion of the sheet along the forward direction. Step b) includes thereafter controlling the pick motor by comparing an actual pick motor velocity with a desired pick motor velocity.

A sixth method of the invention is for operating a direct current (DC) pick motor of a pick system to pick a sheet of print media for printing, wherein the pick system has a single-channel pick encoder including an encoder wheel and a sensor. The sensor outputs an oscillating signal having peaks and valleys when the encoder wheel is rotating. The pick system counts the number of transitions between the peaks and valleys to determine sheet position only along a forward direction of the sheet path. The sixth method includes steps a) and b). Step a) includes driving the pick motor with a pulse-width-modulated (PWM) signal which does not change polarity between positive and negative during the picking of a sheet. Step b) includes controlling the pick motor by comparing an actual pick motor velocity with a desired pick motor velocity.

Several benefits and advantages are derived from one or more of the previously-described first through fourth methods of the invention. More accurate control over the pick and feed operations is achieved by having sheet position for obtaining both desired pick and feed motor velocities be determined at any one time by only one of the pick and feed systems. This avoids inaccuracies in coordinating the desired velocities of two systems when both desired velocities are dependent upon, but use different values for, sheet position due to error buildup from manufacturing tolerances and resolution limits in the components of the two systems. By having the pick system be in contact with the sheet when sheet position is determined by the pick system for obtaining desired velocities and having the feed system be in contact with the sheet when sheet position is determined by the feed system for obtaining desired velocities insures that contact with the sheet is never lost in determining sheet position for obtaining desired velocities. By having the pick motor feedback controlled wherein the actual pick motor velocity is always determined by the pick system (instead of being determined by the feed system after the happening of the predetermined event) and having the feed motor feedback controlled wherein the actual feed motor velocity is always determined by the feed system (instead of being determined by the pick system before the happening of the predetermined event) simplifies implementation of motor control since velocity depends on changes in position over time and not on actual position and therefore actual velocity determination is immune to inaccuracies in determining position.

Several benefits and advantages are derived from one or more of the previously-described fifth and sixth methods of the invention. Starting the pick operation with an input to the pick motor sufficient to prevent any teetering rotational motion of the encoder wheel will prevent any teetering signal transitions which would be falsely counted as motion along the forward direction leading to an erroneous determination of sheet position. Driving a DC pick motor with a PWM signal which does not change polarity between positive and negative during the picking of a sheet will prevent counter-rotational driving of the encoder wheel which would be falsely counted as motion along the forward direction leading to an erroneous determination of sheet position.

DETAILED DESCRIPTION

Figure 1:
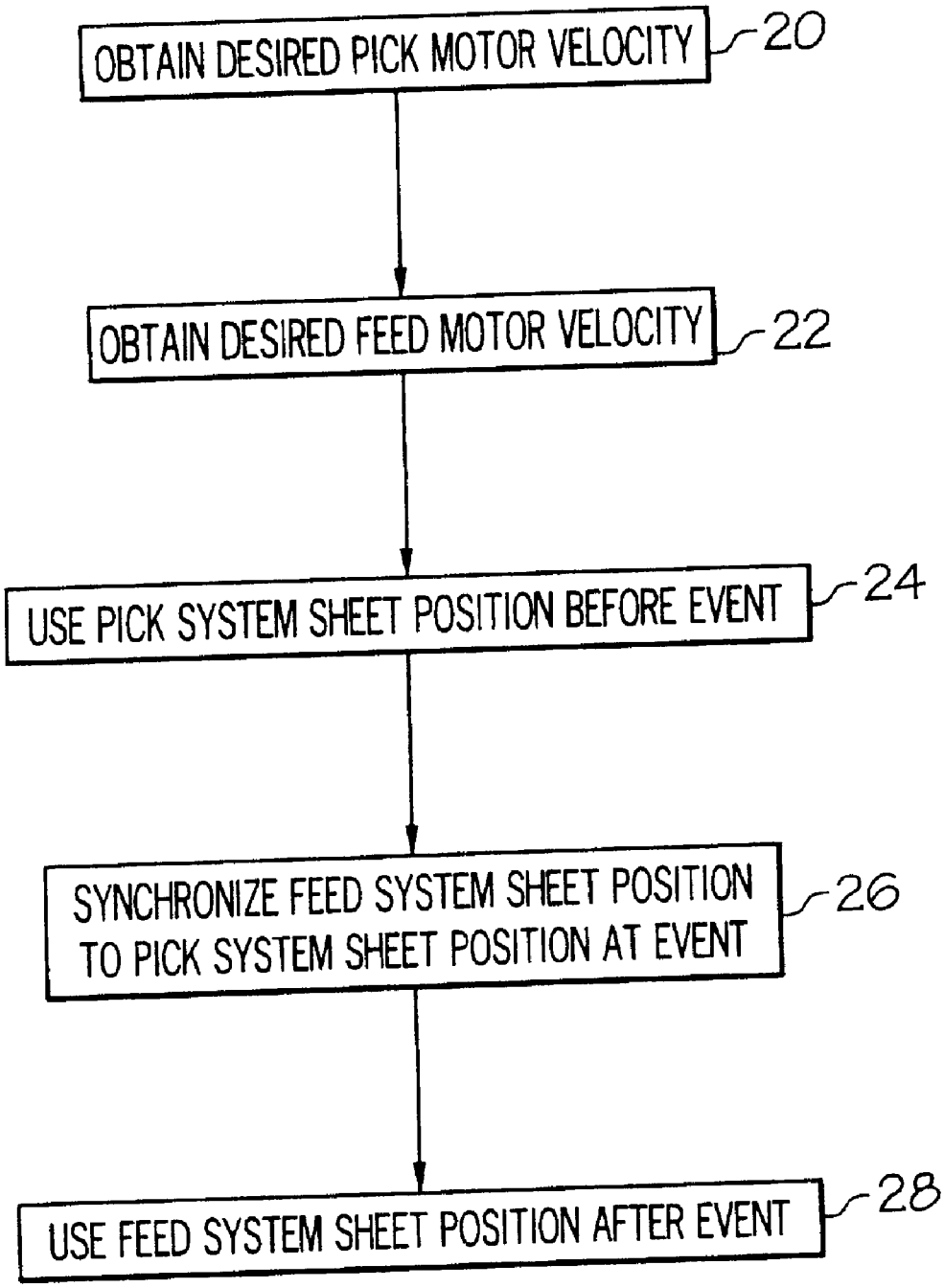
FIG. 1 is a flow chart of a first method of the invention for operating a pick motor of a pick system and a separate feed motor of a feed system to pick and feed a sheet of print media for printing.

Referring to FIGS. 1–4, a first method of the invention is for operating a pick motor 10 of a pick system 12 and a separate feed motor 14 of a feed system 16 to pick and feed a sheet 18 of print media for printing, wherein the pick and feed systems 12 and 14 each determine sheet position. The first method includes steps a) through e) as seen in the flow chart of FIG. 1. Step a) is labeled as "Obtain Desired Pick Motor Velocity" in block 20 of FIG. 1. Step a) includes obtaining a desired pick motor velocity for the pick motor 10 from a first function 21 of sheet position. Step b) is labeled as "Obtain Desired Feed Motor Velocity" in block 22 of FIG. 1. Step b) includes obtaining a desired feed motor velocity for the feed motor 14 from a second function 23 of sheet position. Step c) is labeled as "Use Pick System Sheet Position Before Event" in block 24 of FIG. 1. Step c) includes using the sheet position determined by the pick system 12 for both steps a) and b) until the happening of a predetermined event. Step d) is labeled as "Synchronize Feed System Sheet Position to Pick System Sheet Position At Event" in block 26 of FIG. 1. Step d) includes synchronizing the determined sheet position of the feed system 16 to the determined sheet position of the pick system 12 upon the happening of the predetermined event. Step e) is labeled as "Use Feed System Sheet Position After Event" in block 28 of FIG. 1. Step e) includes using the sheet position determined by the feed system 16 for both steps a) and b) after the happening of the predetermined event. It is noted that a system is said to determine sheet position when that system provides a measurement signal which is used to calculate sheet position regardless of whether processing of the measurement signal into a sheet position is performed by the system itself or by some other apparatus.

In one example of the first method, steps a) through e) are performed in any order, the set of steps a), b) and c) is repeated many times before the happening of the predetermined event, step d) is performed once, and the set of steps a), b) and d) is repeated many times after the happening of the predetermined event all to pick and feed a sheet 18 for printing. It is noted that more accurate control over the pick and feed operations is achieved by having sheet position for determining both desired pick and feed motor velocities be determined at any one time by only one of the pick and feed systems 12 and 16. This avoids inaccuracies in coordinating the desired velocities of two systems when both desired velocities are dependent upon, but use different values for, sheet position due to error buildup from manufacturing tolerances and resolution limits in the components of the two systems.

A second method of the invention is identical to the previously-described first method but also requires the pick system 12 to be in contact with the sheet 18 when the sheet position determined by the pick system 12 is used for both steps a) and b) and further requires the feed system 16 to be in contact with the sheet 18 when the sheet position determined by the feed system 16 is used for both steps a) and b). It is noted that by having the pick system 12 be in contact with the sheet 18 when sheet position is determined by the pick system 12 and having the feed system 16 be in contact with the sheet 18 when sheet position is determined by the feed system 16 insures that contact with the sheet 18 is never lost in determining sheet position.

A third method of the invention is identical to the previously-described first method but also includes steps f) and g). Step f) includes controlling the pick motor 10 by comparing an actual pick motor velocity determined by the pick system 12 with the desired pick motor velocity. Step g) includes controlling the feed motor 14 by comparing an actual feed motor velocity determined by the feed system 16 with the desired feed motor velocity. It is noted that by having the pick motor 10 feedback controlled wherein the actual pick motor velocity is always determined by the pick system 12 (instead of being determined by the feed system 16 after the happening of the predetermined event) and having the feed motor 14 feedback controlled wherein the actual feed motor velocity is always determined by the feed system 16 (instead of being determined by the pick system 12 before the happening of the predetermined event) simplifies implementation of motor control since velocity depends on changes in position over time and not on actual position and therefore actual velocity determination is immune to inaccuracies in determining position.

A fourth method of the invention is identical to the previously-described third method but also requires the pick system 12 to be in contact with the sheet 18 when the sheet position determined by the pick system 12 is used for both steps a) and b) and further requires the feed system 16 to be in contact with the sheet 18 when the sheet position determined by the feed system 16 is used for both steps a) and b).

Figure 2:
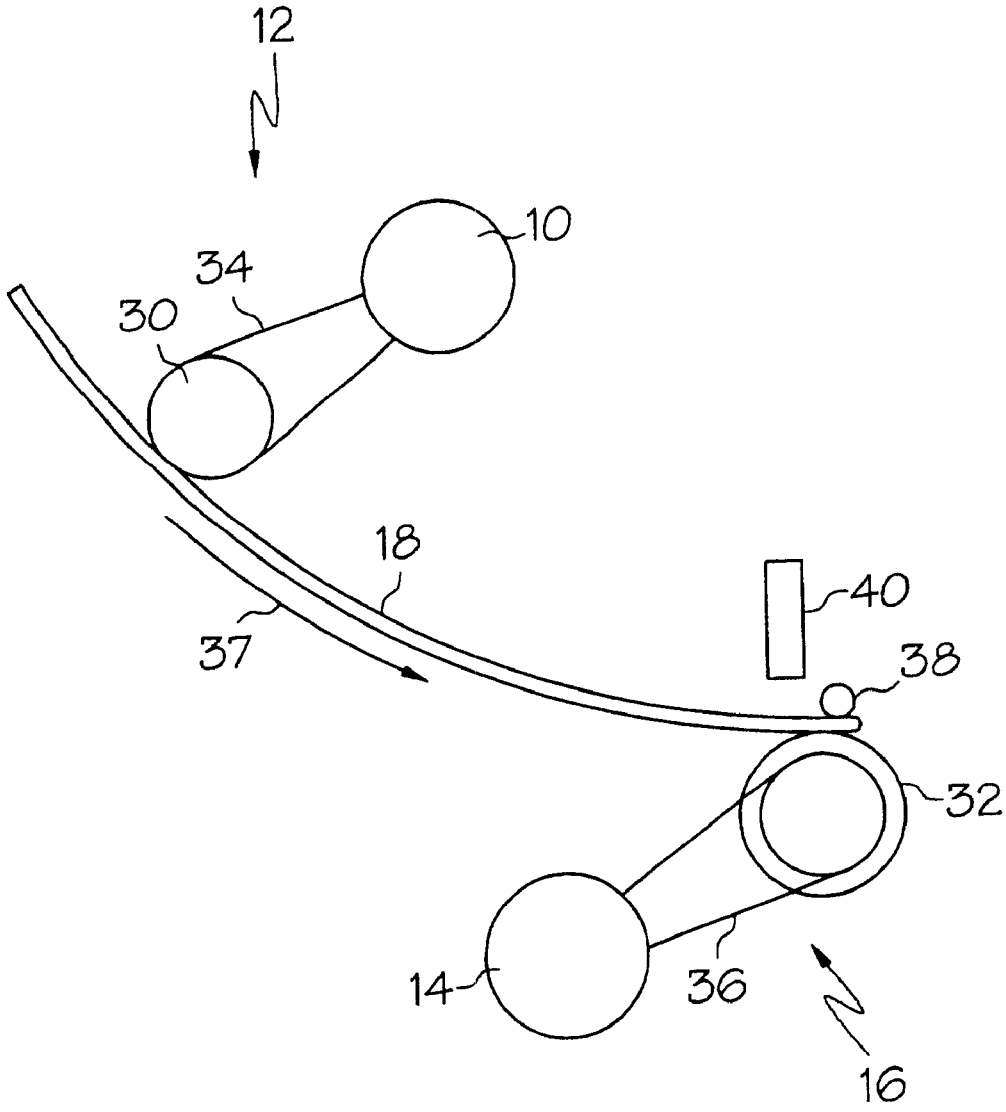
FIG. 2 is a schematic view of one embodiment of apparatus used for performing the first method of FIG. 1.

As seen in FIG. 2, in one embodiment of apparatus used for performing the first method or the second, third or fourth method of the invention, the pick system 12 includes a pick roller 30 driven by the pick motor 10 and engaging the sheet 18 during picking of the sheet 18 (such as picking the top sheet in a tray, not shown). In this embodiment, the feed system 16 includes a feed roller 32 driven by the feed motor 14 and engaging the sheet 18 during feeding of the sheet 18. In one example, the pick motor 10 drives the pick roller 30 via a pick drive belt 34, and the feed motor 14 drives the feed roller 32 via a feed drive belt 36. In the same or another example, the pick roller 30 is in contact with the sheet 18 when the sheet position determined by the pick system 12 is used for both steps a) and b), and the feed roller 32 is in contact with the sheet 18 when the sheet position determined by the feed system 16 is used for both steps a) and b). In the same or a further example, the sheet 18 is a paper sheet, and the feed motor 14 indexes the paper sheet during printing. In this example, the forward direction of the paper path is indicated by arrow 37 in FIG. 2. Examples of printing include, without limitation, inkjet-printer printing, fax-machine printing, and copier-machine printing. Other examples of printing are left to the artisan.

In one implementation of any of the methods of the invention, the pick system 12 determines sheet position from a pick encoder (not shown in the figures) operatively connected to the pick motor 12. In this implementation, the feed system 16 determines sheet position from a feed encoder (also not shown in the figures) operatively connected to the feed motor 14. In one example, the pick encoder is operatively connected to the pick motor 12 by being attached to the shaft of either the pick roller 30 or the pick motor 10, and the feed encoder is operatively connected to the feed motor 14 by being attached to the shaft of either the feed roller 32 or the feed motor 14. Sheet position is conventionally determined from an encoder output as is known to those skilled in the art.

In the same or a different implementation of any of the methods of the invention, the predetermined event occurs substantially when the feed system 16 first grabs the sheet 18. In one example, sheet position is the sheet position of the leading edge of the sheet 18. As seen in FIG. 2, in one embodiment of apparatus used for performing any of the methods of the invention, the feed system 16 also includes a nip roller 38 disposed adjacent the feed roller 32 and includes a sheet sensor 40 disposed upstream from the nip roller 38 wherein the nip roller 38 is disposed a known first distance 42 (seen in FIG. 3) from a sensed sheet position 44 (also seen in FIG. 3) corresponding to when the sheet sensor 40 first senses the presence of the sheet 18. In this embodiment, the predetermined event is a sheet position 46 corresponding to the sensed sheet position 44 plus the first distance 42. In one design, the sheet sensor 40 includes a flag (not shown in the figures) tripped by the leading edge of the advancing sheet 18 and detected by a light detector when the tripped flag blocks light aimed by a light emitter at the light detector (such light emitter and light detector of the sheet sensor 40 not shown in the figures).

Figure 3:
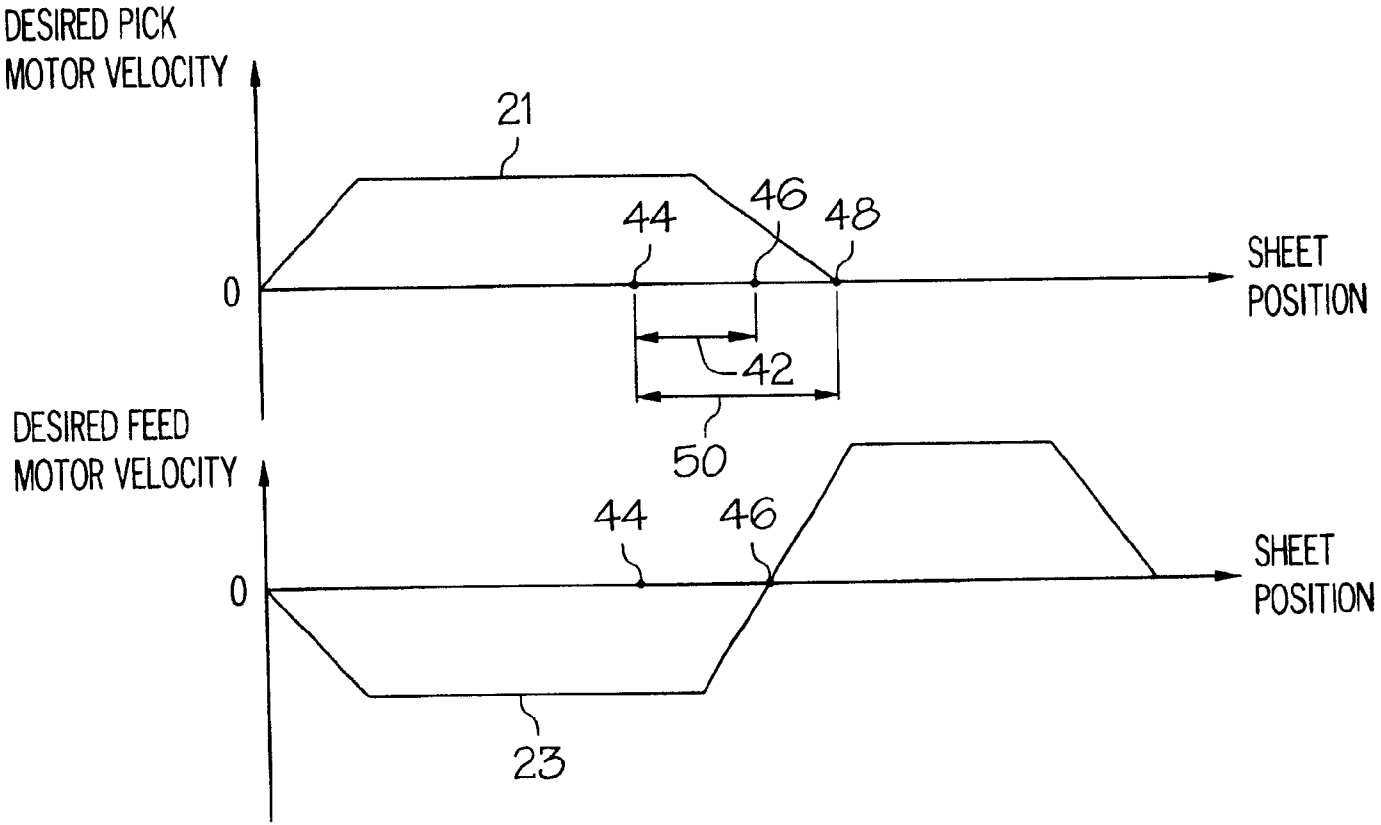
FIG. 3 is a graph of one example of a desired pick motor velocity versus sheet position and of a desired feed motor velocity versus sheet position for the pick and feed motors of FIG. 2.

In one variation of the previously described implementation having the nip roller 38 and the sheet sensor 40, the second function 23, as seen in FIG. 3, includes ramping the desired feed motor velocity from zero to a constant negative deskew velocity and then ramping the desired feed motor velocity from the constant negative deskew velocity to a constant positive feed velocity, wherein the change in desired feed motor velocity direction from negative (corresponding to a sheet-path direction opposite to direction 37) to positive (corresponding to a sheet-path direction equal to direction 37) occurs at the sheet position 46 corresponding to the sensed sheet position 44 plus the first distance 42. In this variation, the predetermined event is the change in feed motor velocity direction from negative to positive. The definition and implementation of other predetermined events are left to the artisan.

In the same or a different implementation of any of the methods of the invention, the first function 21, seen in FIG. 3, includes ramping the desired pick motor velocity up from zero to a constant positive pick velocity and then ramping the desired pick motor velocity down to zero, and wherein the ramped-down zero pick motor velocity is reached at a preselected sheet position 48 corresponding to when the pick roller 30 stops pushing the sheet 18 forward. It is noted that preselected sheet position 48 is greater than sheet position 46. In one example, the preselected sheet position 48 is a sheet position corresponding to the sensed sheet position 44 plus a known second distance 50. An alternative first function (not shown) includes ramping the desired pick motor velocity up from zero to a constant positive pick velocity and, after the sheet sensor first senses the presence of the sheet, includes some positive velocity (such as by maintaining a constant voltage, or a constant duty cycle PWM signal, to the pick motor) for a predetermined time or until the sheet reaches the preselected sheet position 48 after which the first function is zero. This maintains system accuracy when using a single-channel low-resolution pick encoder, as is understood by those skilled in the art. Other examples of the first and second functions are left to the artisan.

Figure 4:
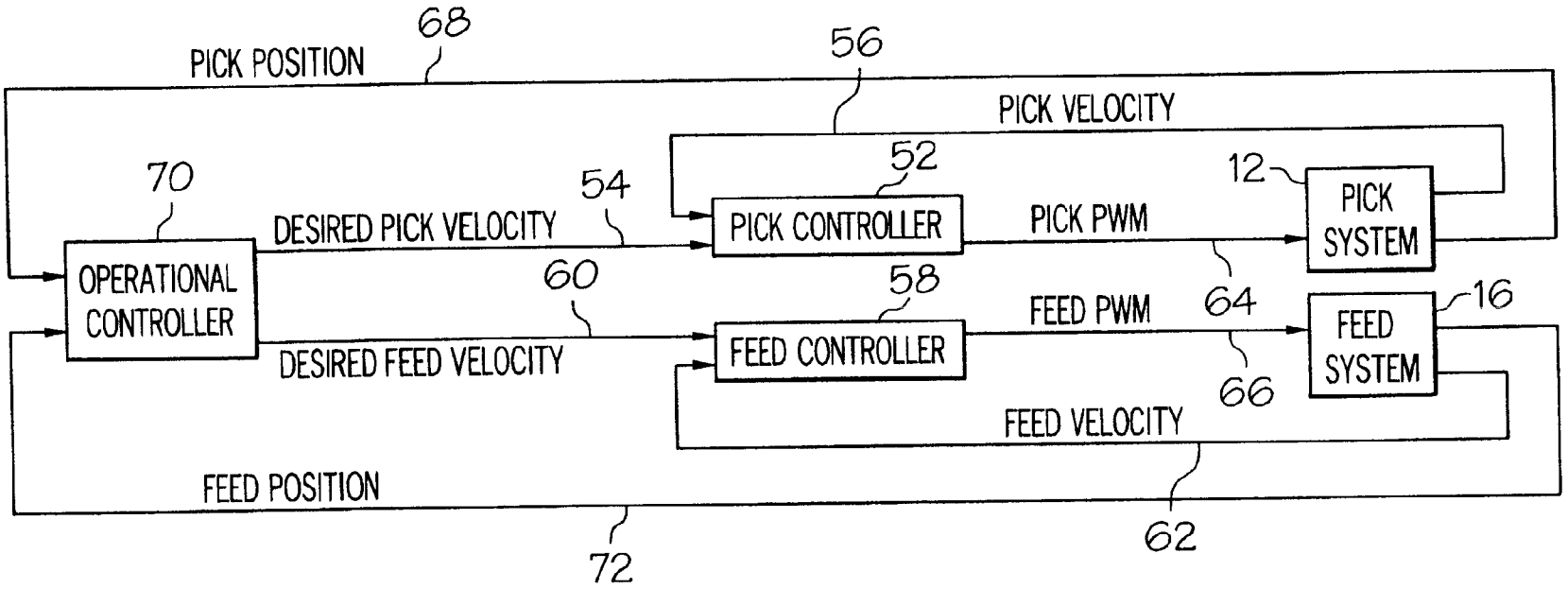
FIG. 4 is a block diagram of one embodiment of a control system for operating the pick and feed systems of FIG. 2.

In one embodiment of a control system, seen in FIG. 4, for operating the pick and feed systems 12 and 16 for any of the methods of the invention, the pick controller 52 compares the desired pick motor velocity 54 with the actual pick motor velocity 56 determined by the pick system 12, and the feed controller 58 compares the desired feed motor velocity 60 with the actual feed motor velocity 62 determined by the feed system 16. The pick controller 52 outputs a PWM pulse-width-modulated signal 64 to the pick motor 10 (seen in FIG. 2) of the pick system 12, and the feed controller 58 outputs a PWM signal 66 to the feed motor 14 (seen in FIG. 2) of the feed system 16. The sheet position 68 determined by the pick system 12 is inputted to the operational controller 70. The sheet position 72 determined by the feed system 16 is also inputted to the operational controller 70. The operational controller 70 performs steps a) through e) for any of the previously-described methods of the invention. In one implementation, the operational controller 70 is a printer-controller ASIC (Application Specific Integrated Circuit) of an inkjet printer. In one variation, the pick and feed controllers 52 and 58 are also part of the ASIC.

Figure 5:
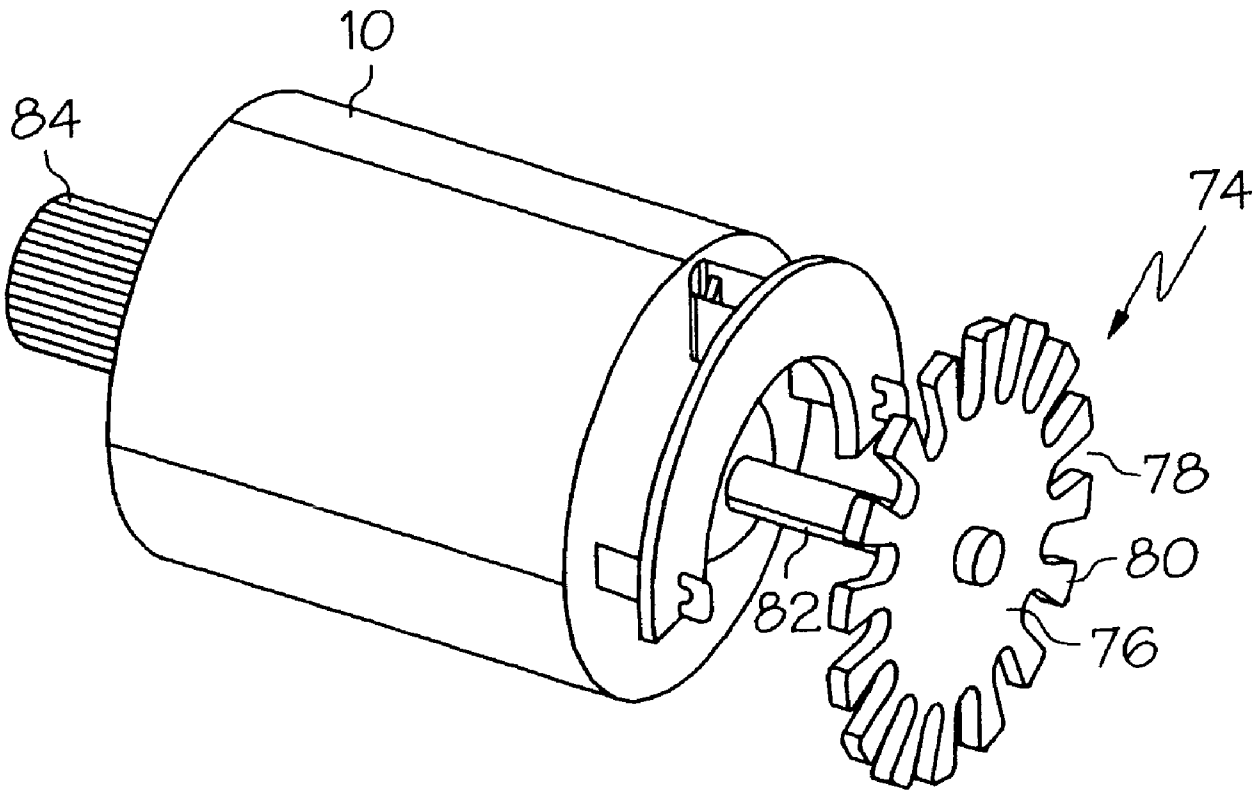
FIG. 5 is a perspective view of one embodiment of a pick motor (such as the pick motor of FIG. 2) and an encoder wheel attached to the pick motor.

Referring to FIGS. 2 and 5, a fifth method of the invention is for operating a pick motor 10 of a pick system 12 to pick a sheet 18 of print media for printing, wherein the pick system 12 has a single-channel pick encoder 74 including an encoder wheel 76 and a sensor (not shown), wherein the encoder wheel 76 is operatively connected to the pick motor 10, wherein the sensor outputs an oscillating signal having peaks and valleys when the encoder wheel 76 is rotating, and wherein the pick system 12 counts the number of transitions between the peaks and valleys to determine sheet position only along a forward direction 37 of the sheet path. The fifth method includes steps a) and b). Step a) includes starting a pick operation of picking a sheet 18 by driving the pick motor 10 in a first direction, to move a sheet 18 along the forward direction 37, with an input sufficient to prevent any teetering transitions which would be falsely counted as motion of the sheet 18 along the forward direction; 37. Step b) includes thereafter controlling the pick motor 10 by comparing an actual pick motor velocity with a desired pick motor velocity. It is noted that the desired pick motor velocity may or may not be a function of sheet position.

In a first arrangement, as seen in FIG. 5, the encoder wheel 76 has a circular array of transparent portions 78 spaced apart by intervening opaque portions 80. In this arrangement, the sensor is an optical sensor disposed to sense rotational transitions between adjacent transparent and opaque portions 78 and 80. In a second arrangement, not shown, the transparent and opaque portions are replaced with magnetic and non-magnetic portions, and the sensor senses the magnetic portions. Other types of encoder wheels and sensors are left to the artisan.

In one design, as seen in FIG. 5, the encoder wheel 76 is attached to a rear-shaft extension 82 of the pick motor 10, and the pick drive belt 34 (seen in FIG. 2) is placed over and driven by a front drive belt gear 84 of the pick motor 10. In one construction, the encoder wheel 76 comprises molded plastic. In the same or another construction involving the previously-described first arrangement, the transparent portions 78 are a circular array of cutouts, and the opaque portions 80 are radially-outwardly-extending tabs. Other locations, shapes and arrangements of the transparent and opaque portions are left to the artisan. In the same or another construction involving the previously-described first arrangement, the optical sensor has a light emitter disposed on one side of the encoder wheel 76 and a light detector disposed on the other side of the encoder wheel 76 facing the light emitter wherein light is detected for an intervening transparent portion 78 but not for an intervening opaque portion 80 of the encoder wheel 76. The use of other optical encoders is left to the artisan.

In one example, the fifth method also includes the step of determining the actual pick motor velocity from the number of counted transitions over time wherein the actual pick motor velocity at a first time is determined by averaging the actual pick motor velocities at a predetermined number of previous times. This is of benefit when, in the preciously-described first arrangement, the pick encoder 74 is a low-resolution pick encoder having a relatively small number (such as 32) of transparent portions 78 and an equal small number (such as 32) of opaque portions 80 of the encoder wheel 76. The choice of a particular number of transparent and opaque portions for the encoder wheel and a particular averaging technique for determining actual pick motor velocity is left to the artisan based on the accuracy requirements for a particular pick system 12.

In the same or a different example, the pick motor 10 is a direct current (DC) motor, and the pick motor 10 is driven and controlled by a pulse-width-modulated (PWM) signal which does not change polarity between positive and negative during the picking of a sheet 18. In one modification, the fifth method also includes the step throughout the picking of a sheet 18 of setting a lower limit on the absolute value of the PWM signal to prevent any motion of the pick motor 10 in a direction opposite to the first direction. In one variation, the lower limit is a zero value. In a different variation, the lower limit is a non-zero value. In one application, for either variation, the absolute value of the input of step a) is greater than the lower limit.

In a modified fifth method, which is otherwise identical to the previously-described fifth method, the pick system 12 cooperates with a feed system 16 having a separate feed motor 14 all to pick and feed a sheet 18 of print media for printing. In one implementation, the fifth method or the modified fifth method is practiced together with any of the previously described first through fourth methods of the invention.

Referring again to FIGS. 2 and 5, a sixth method of the invention is for operating a direct current (DC) pick motor 10 of a pick system 12 to pick a sheet 18 of print media for printing, wherein the pick system 12 has a single-channel pick encoder 74 including an encoder wheel 76 and a sensor (not shown), wherein the encoder wheel 76 is operatively connected to the pick motor 10, wherein the sensor outputs an oscillating signal having peaks and valleys when the encoder wheel 76 is rotating, and wherein the pick system 12 counts the number of transitions between the peaks and valleys to determine sheet position only along a forward direction 37 of the sheet path. The sixth method includes steps a) and b). Step a) includes driving the pick motor 10 with a pulse-width-modulated (PWM) signal which does not change polarity between positive and negative during the picking of a sheet 18. Step b) includes controlling the pick motor 10 by comparing an actual pick motor velocity with a desired pick motor velocity. It is noted that the desired pick motor velocity may or may not be a function of sheet position. The previously-described arrangements, designs, constructions, examples, modifications, variations, and applications of the fifth method are applicable in any combination to the sixth method, and the previously-described examples, embodiments, implementations, designs, and variations of the first through the fourth methods are applicable in any combination to the fifth and sixth methods.

In a modified sixth method, which is otherwise identical to the previously-described sixth method, the pick system 12 cooperates with a feed system 16 having a separate feed motor 14 all to pick and feed a sheet 18 of print media for printing. In one implementation, the sixth method or the modified sixth method is practiced together with any of the previously described first through fourth methods of the invention.

In one enablement, not shown, of the fifth and sixth methods, a first sheet is picked from a first tray by rotating the pick motor in a clockwise direction to move the first sheet in a forward direction of the paper path, and in a separate picking operation a second sheet is picked from a second tray by rotating the pick motor in a counterclockwise direction. A clutch provides the coupling of the pick motor to the pick roller for the first tray during clockwise rotation for the picking of the first sheet from the first tray and provides the coupling of the pick motor to pick roller for the second tray during counterclockwise rotation for the picking of the second sheet from the second tray. In another or the same enablement, the pick motor is controlled by a standard proportional-integral (PI) velocity control.

Several benefits and advantages are derived from one or more of the previously-described first through fourth methods of the invention. More accurate control over the pick and feed operations is achieved by having sheet position for obtaining both desired pick and feed motor velocities be determined at any one time by only one of the pick and feed systems. This avoids inaccuracies in coordinating the desired velocities of two systems when both desired velocities are dependent upon, but use different values for, sheet position due to error buildup from manufacturing tolerances and resolution limits in the components of the two systems. By having the pick system be in contact with the sheet when sheet position is determined by the pick system for obtaining desired velocities and having the feed system be in contact with the sheet when sheet position is determined by the feed system for obtaining desired velocities insures that contact with the sheet is never lost in determining sheet position for obtaining desired velocities. By having the pick motor feedback controlled wherein the actual pick motor velocity is always determined by the pick system (instead of being determined by the feed system after the happening of the predetermined event) and having the feed motor feedback controlled wherein the actual feed motor velocity is always determined by the feed system (instead of being determined by the pick system before the happening of the predetermined event) simplifies implementation of motor control since velocity depends on changes in position over time and not on actual position and therefore actual velocity determination is immune to inaccuracies in determining position.

Several benefits and advantages are derived from one or more of the previously-described fifth and sixth methods of the invention. Starting the pick operation with an input to the pick motor sufficient to prevent any teetering rotational motion of the encoder wheel will prevent any teetering signal transitions which would be falsely counted as motion along the forward direction leading to an erroneous determination of sheet position. Driving a DC pick motor with a PWM signal which does not change polarity between positive and negative during the picking of a sheet will prevent counter-rotational driving of the encoder wheel which would be falsely counted as motion along the forward direction leading to an erroneous determination of sheet position.

The foregoing description of several methods of the invention has been presented for purposes of illustration. It is not intended to be exhaustive or to limit the invention to the precise methods disclosed, and obviously many modifications and variations are possible in light of the above teaching. It is intended that the scope of the invention be defined by the claims appended hereto.

What is claimed is:

1. A method for operating a pick motor of a pick system and a separate feed motor of a feed system to pick and feed a sheet of print media for printing, wherein the pick and feed systems each determine sheet position, and wherein the method comprises the steps of:

a) obtaining a desired pick motor velocity for the pick motor from a first function of sheet position;

b) obtaining a desired feed motor velocity for the feed motor from a second function of sheet position;

c) using the sheet position determined by the pick system for both steps a) and b) until the happening of a predetermined event;

d) synchronizing the determined sheet position of the feed system to the determined sheet position of the pick system upon the happening of the predetermined event; and e) using the sheet position determined by the feed system for both steps a) and b) after the happening of the predetermined event.

2. The method of claim 1, wherein the pick system is in contact with the sheet when the sheet position determined by the pick system is used for both steps a) and b), and wherein the feed system is in contact with the sheet when the sheet position determined by the feed system is used for both steps a) and b).

3. The method of claim 1, also including, before and after the happening of the predetermined event, the step of controlling the pick motor by comparing an actual pick motor velocity determined by the pick system with the desired pick motor velocity and the step of controlling the feed motor by comparing an actual feed motor velocity determined by the feed system with the desired feed motor velocity.

4. The method of claim 1, wherein the pick system includes a pick roller driven by the pick motor and engaging the sheet during picking of the sheet, and wherein the feed system includes a feed roller driven by the feed motor and engaging the sheet during feeding of the sheet.

5. The method of claim 4, wherein the pick system determines sheet position from a pick encoder operatively connected to the pick motor, and wherein the feed system determines sheet position from a feed encoder operatively connected to the feed motor.

6. The method of claim 5, wherein the pick roller is in contact with the sheet when the sheet position determined by the pick system is used for both steps a) and b), and wherein the feed roller is in contact with the sheet when the sheet position determined by the feed system is used for both steps a) and b).

7. The method of claim 4, wherein the feed system also includes a nip roller disposed adjacent the feed roller and includes a sheet sensor disposed upstream from the nip roller, wherein the nip roller is disposed a first distance from a sensed sheet position corresponding to when the sheet sensor first senses the presence of the sheet, and wherein the predetermined event is a sheet position corresponding to the sensed sheet position plus the first distance.

8. The method of claim 4, wherein the feed system also includes a nip roller disposed adjacent the feed roller and includes a sheet sensor disposed upstream from the nip roller, wherein the nip roller is disposed a first distance from a sensed sheet position corresponding to when the sheet sensor first senses the presence of the sheet, wherein the second function includes ramping the desired feed motor velocity from zero to a constant negative deskew velocity and then ramping the desired feed motor velocity from the constant negative deskew velocity to a constant positive feed velocity, wherein the change in desired feed motor velocity direction from negative to positive occurs at a sheet position corresponding to the sensed sheet position plus the first distance, and wherein the predetermined event is the change in feed motor velocity direction from negative to positive.

9. The method of claim 8, wherein the first function includes ramping the desired pick motor velocity up from zero to a constant positive pick velocity and then ramping the desired pick motor velocity down to zero, and wherein the ramped-down zero pick motor velocity is reached at a preselected sheet position corresponding to when the pick roller stops pushing the sheet forward.

10. The method of claim 8, wherein the first function includes ramping the desired pick motor velocity up from zero to a constant positive pick velocity and, after the sheet sensor first senses the presence of the sheet, includes some positive velocity for a predetermined time or until the sheet reaches a preselected sheet position corresponding to when the pick roller stops pushing the sheet forward after which the first function is zero.

11. A method for operating a pick motor of a pick system and a separate feed motor of a feed system to pick and feed a sheet of print media for printing, wherein the pick and feed systems each determine sheet position, and wherein the method comprises the steps of:

a) obtaining a desired pick motor velocity for the pick motor from a first function of sheet position;

b) obtaining a desired feed motor velocity for the feed motor from a second function of sheet position;

c) using the sheet position determined by the pick system for both steps a) and b) until the happening of a predetermined event;

d) synchronizing the determined sheet position of the feed system to the determined sheet position of the pick system upon the happening of the predetermined event; and e) using the sheet position determined by the feed system for both steps a) and b) after the happening of the predetermined event, wherein the pick system is in contact with the sheet when the sheet position determined by the pick system is used for both steps a) and b), and wherein the feed system is in contact with the sheet when the sheet position determined by the feed system is used for both steps a) and b).

12. The method of claim 11, wherein the predetermined event occurs substantially when the feed system first grabs the sheet.

13. The method of claim 12, wherein the sheet is a paper sheet, and wherein the feed motor indexes the paper sheet during printing.

14. A method for operating a pick motor of a pick system and a separate feed motor of a feed system to pick and feed a sheet of print media for printing, wherein the pick and feed systems each determine sheet position, and wherein the method comprises the steps of:

a) obtaining a desired pick motor velocity for the pick motor from a first function of sheet position;

b) obtaining a desired feed motor velocity for the feed motor from a second function of sheet position;

c) using the sheet position determined by the pick system for both steps a) and b) until the happening of a predetermined event;

d) synchronizing the determined sheet position of the feed system to the determined sheet position of the pick system upon the happening of the predetermined event;

e) using the sheet position determined by the feed system for both steps a) and b) after the happening of the predetermined event;

f) controlling the pick motor by comparing an actual pick motor velocity determined by the pick system with the desired pick motor velocity; and g) controlling the feed motor by comparing an actual feed motor velocity determined by the feed system with the desired feed motor velocity.

15. The method of claim 14, wherein the predetermined event occurs substantially when the feed system first grabs the sheet.

16. The method of claim 15, wherein the sheet is a paper sheet, and wherein the feed motor indexes the paper sheet during printing.

17. A method for operating a pick motor of a pick system and a separate feed motor of a feed system to pick and feed a sheet of print media for printing, wherein the pick and feed systems each determine sheet position, and wherein the method comprises the steps of:

a) obtaining a desired pick motor velocity for the pick motor from a first function of sheet position;

b) obtaining a desired feed motor velocity for the feed motor from a second function of sheet position;

c) using the sheet position determined by the pick system for both steps a) and b) until the happening of a predetermined event;

d) synchronizing the determined sheet position of the feed system to the determined sheet position of the pick system upon the happening of the predetermined event;

e) using the sheet position determined by the feed system for both steps a) and b) after the happening of the predetermined event;

f) controlling the pick motor by comparing an actual pick motor velocity determined by the pick system with the desired pick motor velocity; and g) controlling the feed motor by comparing an actual feed motor velocity determined by the feed system with the desired feed motor velocity, wherein the pick system is in contact with the sheet when the sheet position determined by the pick system is used for both steps a) and b), and wherein the feed system is in contact with the sheet when the sheet position determined by the feed system is used for both steps a) and b).

18. The method of claim 17, wherein the predetermined event occurs substantially when the feed system first grabs the sheet.

19. The method of claim 18, wherein the sheet is a paper sheet, and wherein the feed motor indexes the paper sheet during printing.

* * * * *